United States Patent [19]

Straus

[11] 4,007,930

[45] Feb. 15, 1977

[54] CLAMP FOR TENNIS RACQUET

[76] Inventor: Albert E. Straus, 3740 Stirrup Drive, Erie, Pa. 16506

[22] Filed: Dec. 24, 1975

[21] Appl. No.: 644,072

[52] U.S. Cl. ..... 273/74; 206/315 B

[51] Int. Cl.[2] ..... A63B 49/16

[58] Field of Search ..... 273/73 R, 74; 150/52 G; 206/315 B

[56] References Cited

UNITED STATES PATENTS

| | | | |
|---|---|---|---|
| 1,437,378 | 11/1922 | Holmes | 273/74 |
| 1,612,109 | 12/1926 | Flower | 273/74 |
| 3,343,838 | 9/1967 | Baukney | 273/74 |

FOREIGN PATENTS OR APPLICATIONS

| | | | |
|---|---|---|---|
| 18,186 | 2/1929 | Australia | 273/74 |
| 724,004 | 1/1932 | France | 273/74 |
| 17,415 | 7/1913 | United Kingdom | 273/74 |
| 161,716 | 4/1921 | United Kingdom | 273/74 |
| 355,496 | 8/1931 | United Kingdom | 273/74 |
| 398,694 | 9/1933 | United Kingdom | 273/74 |
| 656,365 | 8/1951 | United Kingdom | 273/74 |

OTHER PUBLICATIONS

"Playboy" Magazine; June 1975; p. 127.

*Primary Examiner*—Richard J. Apley

[57] ABSTRACT

A racquet press made up of two oval shaped members, each member having an inwardly directed peripheral flange engaging the edge of the flange of the other. Each flange has at least four symmetrically arranged flat members attached to its edge remote from the other oval shaped member, a second flange is attached to the adjacent edges of the symmetrically arranged flat members and a web member connects the outer edge of these second flanges. The pin extends through each of the first mentioned flat members and a clamping device is attached to the outer end of the pins so that the pins pull the two symmetrical halves together, clamping the racquet between the flat members.

8 Claims, 6 Drawing Figures

CLAMP FOR TENNIS RACQUET

GENERAL STATEMENT OF INVENTION

The racquet press disclosed herein has a general shape that gives torsional rigidity to prevent warpage of a tennis racquet frame supported in it. The two similar halves may be forced apart so that a tennis racquet with thickness varying between certain limits can be inserted in the opening. Hollow rivets extend between the two halves of the racquet holding them together. A one piece "U" shaped cam lever can be swung around the rivet co-acting with the ramps on the press, thereby clamping the two halves together and clamping the tennis racquet frame between them at four positions thereon. The racquet press fully protects the strings of the racquet and with one partial turn of the cam, gives over and under clamping support in the full-closed position. The racquet press may be provided with a tennis ball holding compartment at its bottom.

OBJECTS OF THE INVENTION

It is an object of the invention to provide an improved racquet press.

Another object of the invention is to provide an improved racquet press that is simple in construction, economical to manufacture, and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

DETAILED DESCRIPTION OF DRAWINGS

Figure 3:
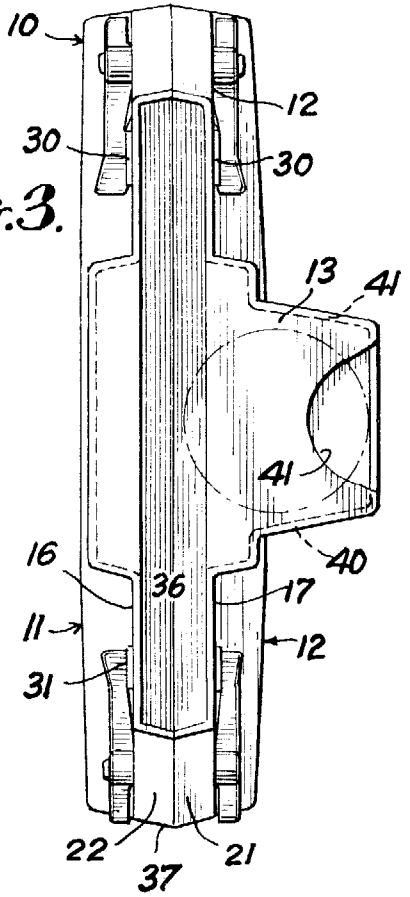
FIG. 3 is an end view of the racquet press.
Figure 1:
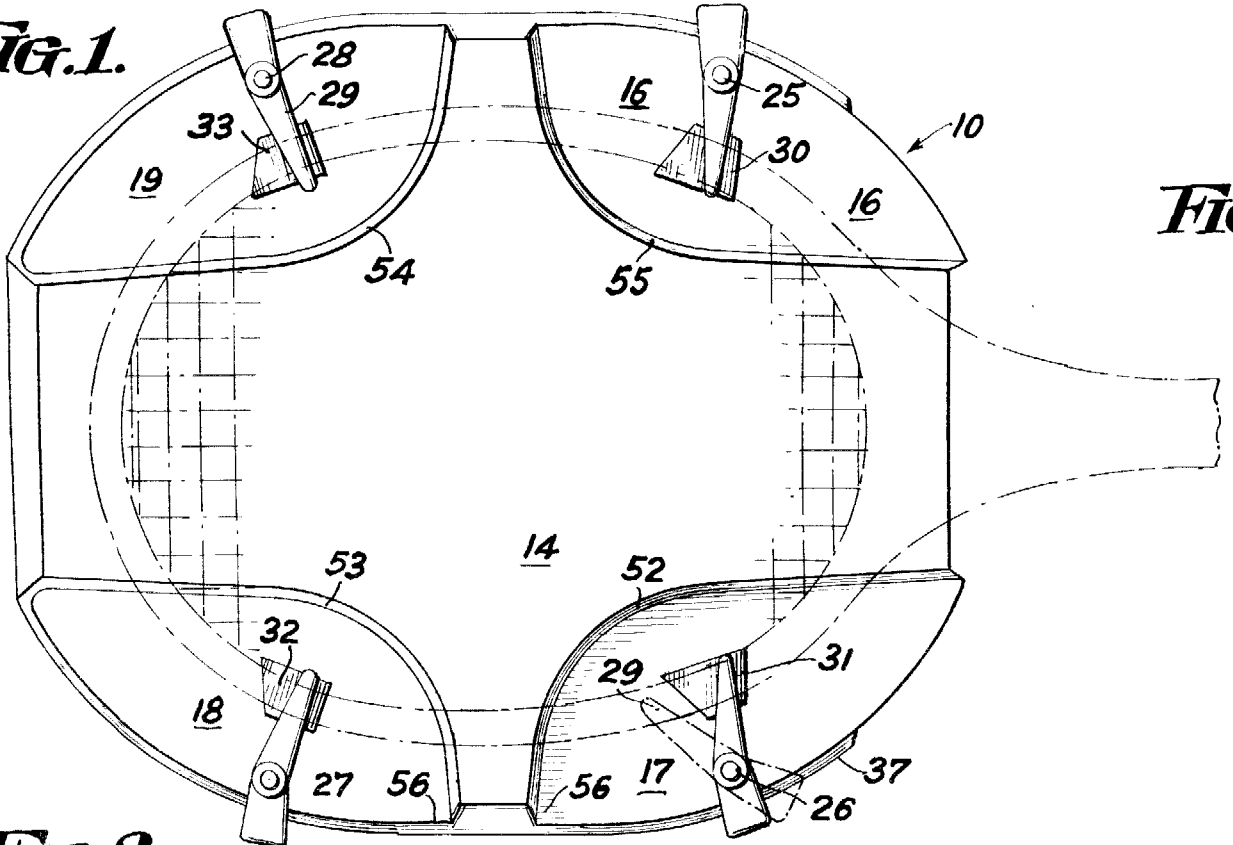
FIG. 1 is a top view of the racquet press according to the invention, showing one of the cam levers removed.
Figure 2:
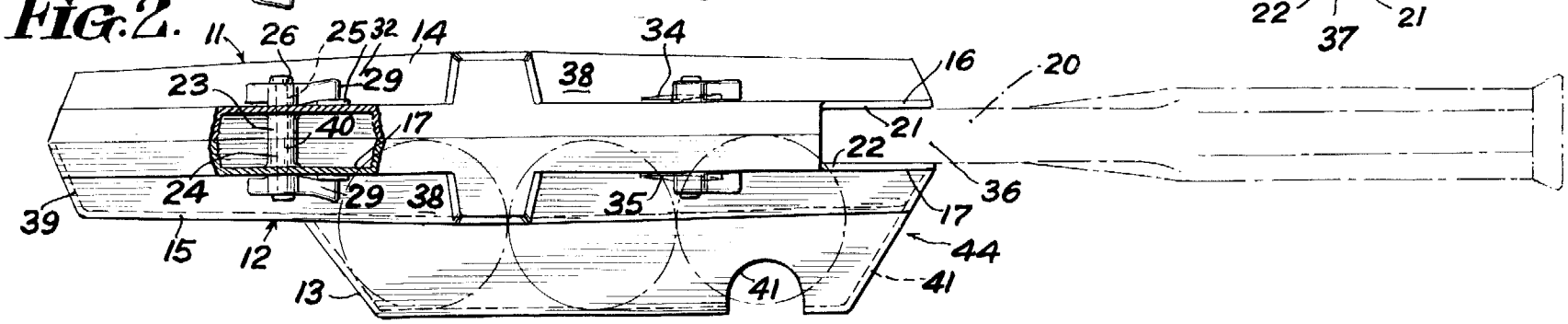
FIG. 2 is a side view of the racquet press, partly in cross section.

Now, with more particular reference to the drawings, the racquet press 10 is made up of an upper part 11 and a lower part 12. The upper part 11 and lower part 12 may be substantially identical with the exception that the lower part 12 may have the ball support pocket 13 integral therewith. The racquet press will be made of a material that is relatively rigid but somewhat resilient, such as, for example, molded fiber glass or some suitable molded themoplastic material. The upper part 11 and lower part 12 each have a cruciform planar surface 14 and 15 that are formed in planes, generally parallel to each other.

Four spaced clamping members 16, 17, 18 and 19 each has a planar surface that is disposed in parallel plane spaced from the other a distance approximately equal to the average thickness of the frame of a conventional tennis racquet indicated generally at 20. The clamping members 16, 17, 18 and 19 define two spaced planar inwardly-facing surfaces 21 and 22 that are spaced from each other a distance equal to the average thickness of a conventional tennis racquet.

Each of the parts 11 and 12 has four outwardly-directed reinforcing flanges 52, 53, 54 and 55 attached to the inner edge of the clamping members and extending around the clamping members with the outer end of the reinforcing flange integrally connected at 56 of the oval shaped flanges 37 at the outer ends. The outwardly-directed reinforcing flanges 52, 53, 54 and 55 are generally crescent shaped and are attached at their outer edges to the cruciform planar members 14 which lie in a plane generally parallel to the plane of the clamping members 16, 17, 18 and 19.

It will be noted that the marginal flanges 37 incline outwardly and toward each other thereby providing a certain amount of resiliency.

A clamp member 29 is pivoted to each corner. Each clamp member 29 is pivoted on a rivet 24, 26, 27 or 28. Clamping members 16, 17, 18 and 19 each has on its inner side a hollow boss 23 or 24 that has a flat inner end that rests on the corresponding end of a hollow boss 24 integral with the clamping member of the other part, limiting the movement of the two parts toward each other. Rivets 24, 26, 27 or 28 extend through the hollow bosses 23 and 24 and receive a rivet 25, 26, 27 or 28.

The inclined cam ramps 30, 31, 32 and 33 are fixed to the outer surfaces of corresponding clamping members 16, 17, 18 and 19 respectively, and these cam ramps 30, 31, 32 and 33 cooperate with cam surfaces on the clamp members 29 that engage cam ramps 30, 31, 32 and 33, forcing the surfaces 16, 17, 18 and 19 toward each other for clamping the racquet press halves therebetween.

Outer peripheral oval shaped flanges 37 together, generally forming a margin V-shaped in cross section, have their outer edges integrally attached to the clamping members 16, 17, 18 and 19 of parts 11 and 12. The ends of flange 37 terminates adjacent the opening 36 providing an opening through which the racquet can be inserted when the cam levers are swung to the proper position.

When in use, the clamps 29 are swung to fully released position and the clamps 29 are moved so that the resilient flange 37 can spring the two parts of the racquet press away from each other to provide the maximum width of opening 36. The tennis racquet frame can then be inserted through the opening 36 and the levers 29 can then be swung to clamping position, forcing the four clamping members 16, 17, 18 and 19 toward each other so that the inner surfaces 21 and 22 will be in clamping relation with the racquet frame.

The inclined flanges 38 connecting the cruciform planar part 14 with the clamping parts 16, 17, 18 and 19 and the flanges provide substantial rigidity against twisting.

The lower part 12 can have the ball-receiving pocket 13 fixed on it. The ball receiving part 13 extend downwardly from the cruciform part 14 on the lower part 12 and provides an elongated container for tennis balls. The slot is provided in the press through which balls can be grasped between the finger and the thumb of the user.

Figures 4, 5, 6:
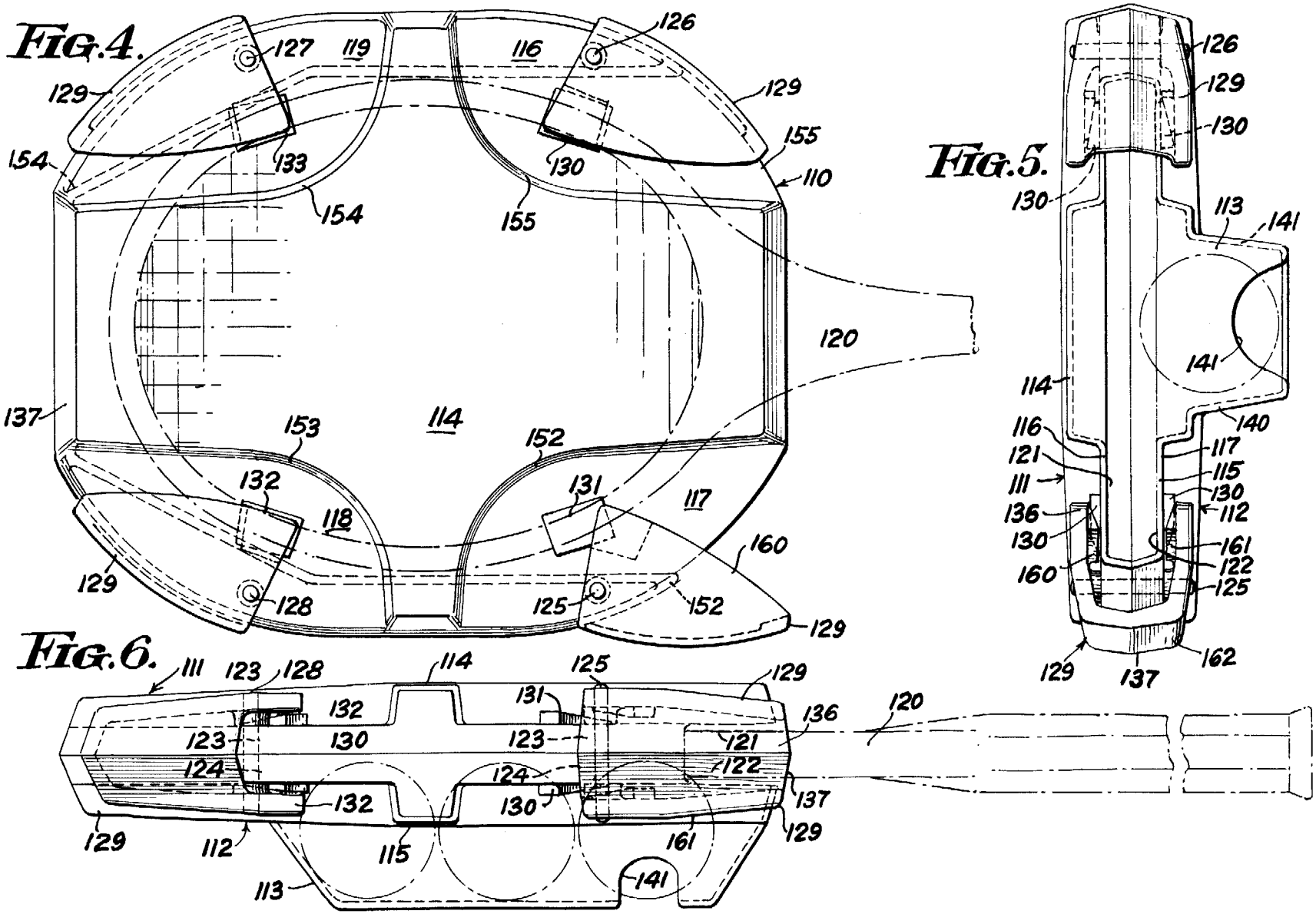
FIG. 4 is a top view of another embodiment of the invention.
FIG. 5 is a side view of the embodiment of FIG. 4.
FIG. 6 is an end view of the embodiment of FIGS. 4 and 5.

In the embodiment of the invention shown in FIGS. 4, 5 and 6, another form of the invention is shown.

Four spaced clamping members 116, 117, 118 and 119 each has a planar surface that is disposed in parallel plane spaced from the other a distance approximately equal to the average thickness of the frame of a conventional tennis racquet indicated generally at 120. The clamping members 116, 117, 118 and 119 define two spaced planar inwardly-facing surfaces 121 and 122 that are spaced from each other a distance equal to the average thickness of a conventional tennis racquet.

Each of the parts 111 and 112 has four outwardly-directed reinforcing flanges 152, 153, 154 and 155 attached to the inner edge of the clamping members and extending around the clamping members with the outer end of the reinforcing flange integrally connected at 156 of the oval shaped flanges 137 at the outer ends. The outwardly-directed reinforcing flanges 152, 153 154 and 155 are generally crescent shaped and are attached at their outer edges to the cruciform planar members 114 which lies in a plane generally parallel to the plane of the clamping members 116, 117, 118 and 119.

It will be noted that the marginal flanges 137 incline outwardly and toward each other thereby providing a certain amount of resiliency.

A clamp member 129 is pivoted to each corner. Each clamp member 129 is pivoted on a rivet 125, 126, 127 or 128. Clamping members 116, 117, 118 and 119 each has on its inner side a hollow boss 123 or 124 that has a flat inner end that rests on the corresponding end of a hollow boss 124 integral with the clamping member of the other part, limiting the movement of the two parts toward each other. Rivets 125, 126, 127 and 128 extend through the hollow bosses 123 and 124 and receive a rivet 125, 126, 127 or 128.

The inclined cam ramps 130, 131, 132 and 133 are fixed to the outer surfaces of corresponding clamping members 116, 117, 118 and 119 respectively, and these cam ramps 130, 131, 132 and 133 cooperate with cam surfaces on the clamp members 129 that engage cam ramps 130, 131, 132 and 133, forcing the surfaces 116, 117, 118 and 119 toward each other for clamping the racquet press halves therebetween.

An outer peripheral oval-shaped flanges 137 together generally form a V-shape in cross section that have their outer edges integrally attached to the clamping members 116, 117, 118 and 119 of parts 111 and 112. The ends of flange 137 terminate adjacent the opening 136 providing an opening through which the racquet can be inserted when the cam levers are swung to the proper position.

When in use, the clamps 129 are swung to fully released position, the clamps 129, 130, 131, 132 and 133 are moved so that the resilient flange 137 can spring the two parts of the racquet press away from each other to provide the maximum width of opening 136. The tennis racquet frame can then be swung to clamping position, forcing the four clamping members 116, 117, 118 and 119 toward each other so that the inner surfaces 121 and 122 will be in clamping relation with the racquet frame.

The lower part 112 can have the ball receiving pocket 113 fixed to it. The ball-receiving part 113 extends downwardly from the cruciform part 114 on the lower part 112 and provides an elongated container for tennis balls. The slot 141 is provided in the press through which balls can be grasped between the finger and thumb of the user.

The clamps 129 are generally U-shaped, having a top member 160 and a bottom member 161 connected together by an intermediate member 162. The outer peripheral edge of each clamp member 129 is curved to conform to the contour of the outer periphery of the flange 137 when the clamps are in clamped position. The upper members 160 and the lower members 161 have the cam surfaces thereon that cooperate with cam members 130, 131, 132 and 133.

The foregoing specification sets forth the invention in its preferred forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A racquet press comprising, two similar parts adapted to receive a tennis racquet therebetween comprising, clamping means for clamping the two parts together, each said part having at least four symmetrically arranged clamping members, each having a flat surface disposed in a plane with the other said flat surfaces on the particular part, each said part having a marginal flange disposed in an oval shape attached to the outer peripheral edges of said clamping members and extending toward the other said part providing torsional rigidity, said flange having ends terminating in spaced relation providing a space for receiving the frame of a tennis racquet, outwardly directed reinforcing flanges attached to the inner edges of said clamping members and an outer web member connected to the outer ends of said outwardly directed flanges, said clamping means extending through said clamping members adapted to urge said clamping members toward each other whereby said clamping members are held in rigid clamp relation to a tennis racquet clamped therebetween, thereby providing full protection for the strings of said racquet.

2. The racquet press recited in claim 1, wherein said reinforcing flanges are integrally attached to said clamping members, said second surfaces have generally crescent-shaped inner edges and their outer edges integrally attached to a first surface, said first surface being disposed in a plane generally parallel to the plane of the said clamping members.

3. The racquet press recited in claim 2 wherein said marginal flanges extend between the outer ends of said second surfaces of said parts and said second surfaces having their outer ends fixed to said oval shaped flange, said racquet press providing full protection for said racquet.

4. The racquet press recited in claim 3 wherein said clamping means comprises a cam surface on each said clamping member and, a cam member connected to the corresponding clamping member on the other part of said racquet press with means to move said cam member relative to said cam surface whereby said two parts of said racquet press are pulled together, providing a convenient racquet press that is expeditious to operate.

5. The racquet press recited in claim 4 wherein each said clamping member has a boss integrally attached thereto extending toward the other said clamping member and a pin extending through the said boss, and said clamping members each further comprise said cam member pivotally supported on at least one end of each said pin, each said cam member has a "U" shaped portion connecting two said cam members on opposite sides of said racquet press together.

6. The racquet press recited in claim 5 wherein the said racquet press comprises a cam member supported on each end of each said pin.

7. A racquet press comprising, two similar parts adapted to receive a tennis racquet therebetween comprising, clamping means for clamping the two parts together, each said part having at least four symmetrically arranged clamping members, each having a flat surface disposed in a plane with the other said flat surfaces on the particular part, each said part having a marginal flange disposed in an oval shape attached to the outer peripheral edges of said clamping members and extending toward the other said part, providing torsional rigidity, said flanges having ends terminating in spaced relation providing a space for receiving the frame of a tennis racquet, outwardly-directed reinforcing flanges attached to the inner edges of said clamping members and an outer web member connected to the outer ends of said outwardly-directed flanges, said clamping means having a member extending through said clamping members adapted to urge said clamping members toward each other, whereby said clamping members are held in rigid clamped relation to a tennis racquet clamped therebetween, thereby providing full protection for the strings of said racquet, said clamping means being generally U-shaped and attached to pins, the legs of each said U-shaped clamping means having a connecting portion connecting them together, a tennis ball receiving pocket being supported on the lower one said part of said racquet press, said ball receiving pocket comprising an outwardly and downwardly extending channel adapted to receive a ball between a tennis racquet's strings in said racquet press and said pocket, and a slot for removing balls from said pocket, said slot being slightly lesser in width than the diameter of an ordinary tennis ball.

8. The racquet recited in claim 7 wherein said clamping members each have a boss thereon, extending toward a corresponding boss on the other said part and, a bore through said boss receiving said pins, each said pin extending through said parts.

* * * * *